United States Patent [19]

Fleissner

[11] 4,002,783

[45] Jan. 11, 1977

[54] PROCESS FOR THE PRODUCTION OF TEXTILE MATERIAL LENGTHS CONTAINING BONDING AGENTS

[75] Inventor: Heinz Fleissner, Egelsbach near Frankfurt am Main, Germany

[73] Assignee: VEPA AG, Switzerland

[22] Filed: Nov. 4, 1974

[21] Appl. No.: 520,949

Related U.S. Application Data

[63] Continuation of Ser. No. 287,831, Sept. 11, 1972, abandoned.

[30] Foreign Application Priority Data

Feb. 6, 1970 Germany ..... 1905746

[52] U.S. Cl. ..... 427/335; 427/354; 427/378; 427/381; 428/904

[51] Int. Cl.[2] ..... B05D 3/00; B05D 3/04; B05D 3/02

[58] Field of Search ..... 427/335, 336, 354, 381, 427/390, 378; 428/904

[56] References Cited

UNITED STATES PATENTS

| | | | |
|---|---|---|---|
| 2,697,048 | 12/1954 | Secrist | 427/354 |
| 2,923,641 | 2/1960 | Graf | 427/354 |
| 3,529,447 | 9/1970 | Fleissner et al. | 427/354 |
| 3,765,974 | 10/1973 | Petersik et al. | 427/354 X |

OTHER PUBLICATIONS

Noble, Royce J., Latex In Industry, pp. 348, 355, 356, 357.

*Primary Examiner*—Michael R. Lusignan
*Attorney, Agent, or Firm*—Craig & Antonelli

[57] ABSTRACT

The present disclosure is directed to a process for the production of a textile material length containing filling or bonding agents which are used in the production of synthetic leather which comprises impregnating the textile material with a thermo-sensibilized bonding or filling agent, heating said impregnated bonding or filling agent contact-free to a temperature at which the bonding agent coagulated and subjecting the textile material to subsequent treatment steps.

11 Claims, 1 Drawing Figure

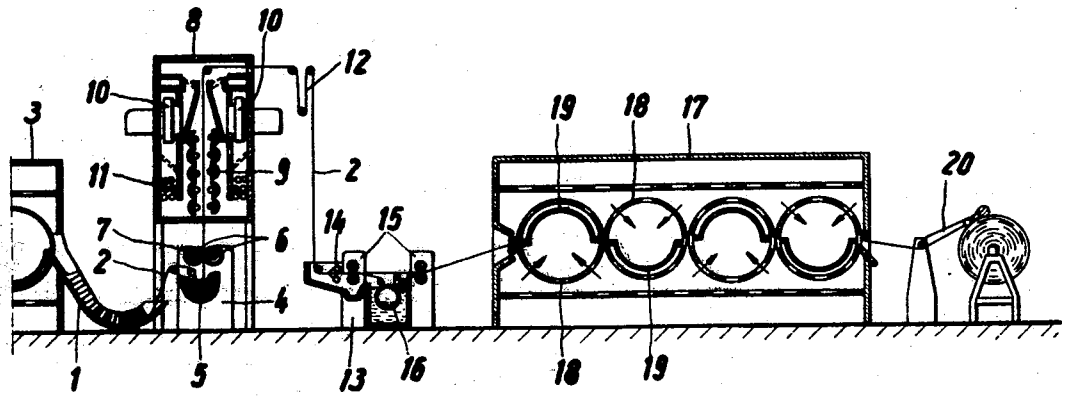
Inventor:
HEINZ FLEISSNER
By
Craig, Antonelli, Stewart & Hill
Attorneys

PROCESS FOR THE PRODUCTION OF TEXTILE MATERIAL LENGTHS CONTAINING BONDING AGENTS

This is a continuation, of application Ser. No. 287,831 filed Sept. 11, 1972, now abandoned.

BACKGROUND OF THE INVENTION

The present invention relates to a process for the production of textile material lengths containing filling or bonding agents which are used particularly for the production of synthetic leather. The filling or bonding agents are dissolved or dispersed in water or in solvents before being applied to the textile material length.

The usual carriers for synthetic leather are shrunk random webs, felts, knit fabrics and fabrics. In order to obtain a compact, leather-like product, these textile material lengths are impregnated with a bonding agent which maintains its elasticity, even after having been hardened.

The bonding agent most generally used is a synthetic latex. After having been impregnated with the synthetic latex, the textile material lengths are dried and hardened in a dryer, e.g., in a stenter or a multi-belt dryer. Apart from the synthetic leather, industrial fleeces, felts, filter materials, carpet needle felts and other material are produced by means of a similar process.

In order to add to the material the required quantity of bonding agent, it is often necessary to apply 300 or more percent (compared to the fiber weight) of bonding agent liquor onto the textile material lengths. Very often this great quantity of bonding agent liquor leads to a heavy contamination of the guiding- and transporting devices inside the dryer. In the course of time, the bonding agents stick to the transporting devices and it becomes very difficult to remove the hard particles. Furthermore, power consumption for the drying process increases accordingly. Another drawback is, that the dryers which have been used for this kind of processing up to now operate with spraying nozzles or infrared radiators. With both operating methods the material lengths are most intensively dried at their surfaces. This results in an outward movement of the bonding agent, so that the distribution of the bonding agent over the cross section of the textile material length is uneven. This uneven distribution of the bonding agent should, by all means, be avoided, particularly with synthetic leather.

If a felt or a web is used as the carrier for synthetic leather, it often happens that the carrier splits when the bonding agent has hardened. If the bonding agent is unevenly distributed over the fiber cross section, this splitting results in the formation of unevenly bonded material layers because there are two types of layer surfaces, i.e. one with a low bonding agent content and one with a higher bonding agent content.

SUMMARY OF THE INVENTION

An object of the present invention is to provide an improved process for eliminating the prior art disadvantages in the production of textile material lengths containing filling or bonding agents.

Another object of the present invention is to provide an improved process for producing synthetic leather wherein the contamination of various elements of the treatment apparatus with the bonding agents used to produce said synthetic leather is substantially avoided.

A further object of the present invention is to provide an improved process for producing synthetic leather which eliminates the disadvantages of bonding agent movement.

Other objects and further scope of applicability of the present invention will become apparent from the detailed description given hereinafter; it should be understood, however, that the detailed description and specific examples, while indicating preferred embodiments of the invention, are given by way of illustration only, since various changes and modifications within the spirit and scope of the invention will be come apparent to those skilled in the art from this detailed description.

A thermo-sensibilized synthetic latex has been developed in order to eliminate the disadvantages of the bonding agent movement. The coagulation point can be pre-set to lie at a required temperature. It is expedient to pre-set it to about 40° to 50° C. This thermo-sensibilized synthetic latex is of great advantage because the bonding agent coagulates before the actual drying process starts and thus it no longer moves during the drying process. If thereis an even impregnation, it is possible to obtain a uniform distribution of the bonding agent over the fiber cross section even with spray-drying or drying by means of infrared radiation. However, the other aforementioned drawbacks have not yet been eliminated up to now.

According to the present invention it has been found that the use of a thermo-sensibilized product, i.e. a synthetic latex as the bonding or filling agent offers even greater advantages if the textile material length is heated to a temperature where the bonding agent coagulates, and if the material length is free of contact after the bonding agent has been applied. The contact-free passage of the textile material until after the coagulation takes place helps to avoid any contamination of the transporting devices. After the coagulation there is no further contamination possible. Another advantage of the use of the thermo-sensibilized bonding agent is that the textile material length can be mechanically dehydrated, e.g. by means of squeezing or suction devices, after the coagulation has taken place and before the material is dried and the bonding agent cured and vulcanized. This mechanical dehydration permits the removal of about 200 percent moisture and more from a textile material length which contains about 300 to 400 percent bonding agent liquor, with very low power consumption. This means that during the subsequent drying process an essentially small amount of water or solvent liquid has to be evaporized.

In accordance with another feature of the present invention, it is suggested to wash the textile material length after the coagulation of the bonding agent, e.g. the synthetic latex, has taken place. The washing step is effected in order to remove the thermo-sensibilizing and other auxiliary elements. Another advantage of the washing of the material is that after said washing, the impregnated textile material length has more breathing activity, that is, a greater air-permeability. A particularly good air-permeability is obtained if the washing liquor is passed through the textile material length at least during a portion of the washing process.

The breathing activity, that is, the air-permeability can be further increased during the drying and vulcanizing processes if the treatment gas, i.e. the heated air or steam or air-stream mixture, which is used for these processes is also passed through the textile material length. The drawing-through of the washing liquor and of the gaseous drying medium is also desirable because it results in an extremely intensive but still careful and uniform processing of the material. The textile material length can thus be dried and vulcanized simultaneously by means of a device which comprises at least one sieve drum means which is subject to a suction draft. It is even more advantageous to convey the textile material length over several sieve drums as this guarantees a passing through of the gas through both sides of the material being treated.

It has been found to be expedient to convey the textile material length almost vertically through a heating zone during the heating-up process. The heating-up of the textile material length which is to cause the coagulation of the bonding agent can be effected by means of infrared radiation and/or spraying of a heated gas, e.g. air or steam and/or by high frequency. Especially with felt and random web carriers, a vertical guidance of the textile material length during the coagulation process is very advantageous as it results in a more uniform, i.e. a more level product. The heating-up zone can be installed vertically above the applicating device, e.g. the padder. However, the reverse arrangement is also possible, i.e., it is possible to apply the bonding agent liquor by means of a lace padder and to lead the material length then vertically downwards through the heating-up zone.

For carrying out the present process, it is suggested to use a unit in which an applicating aggregate, e.g. a padder, is combined with a heating aggregate, e.g. a heating duct, through which the material length is led preferably contact-free during the heating-up process, a washing aggregate comprising preferably at least one sieve drum which is penetrated by the washing liquor from the outside to the inside, as well as an adjoining dehydration device and a dryer which consists of preferably several sieve drums which are subject to a suction draft.

In order to prevent the thermo-sensibilized bonding agent, e.g. the synthetic latex from coagulating in the applicator, it is recommended to provide this applicator with a cooling jacket to cool the bonding agent container. Also the squeezing rollers can also be cooled by a circulating liquid or other means.

A very effective form of construction of the washing aggregate suggests providing this aggregate with a spraying device with a subsequent squeezing unit for pre-washing the textile material length. This squeezing unit is followed by at least one sieve drum bowl with at least one sieve drum which is penetrated by the processing liquor. The sieve drum wash bowl, in its turn, is followed by a heavy squeezing unit. It is also possible to install suction devices instead of the squeezing units. Whereas the sprayed-on liquid is preferably drained off, it is of advantage to circulate the processing liquor in the sieve drum wash bowl and to replace only part of the circulated liquor by fresh water. If, instead of water, a solvent is added to the bonding agent liquor, this solvent can be removed from the textile material length partially in the heating-up aggregate and partially in the washing aggregate. The liquor, that is, the gas containing the solvent can then be transferred to a recovery plant.

BRIEF DESCRIPTION OF THE DRAWINGS

The present invention will become more fully understood from the detailed description given hereinbelow and the accompanying drawings which are given by way of illustration only and thus are not limitative of the present invention and wherein The drawing shows the longitudinal section of one embodiment of the apparatus for carrying out the process of the present invention.

DESCRIPTION OF THE PREFERRED EMBODIMENTS

The apparatus shown in the drawing comprises a material scray 1 which serves as a feeding unit. However, the textile material length 2 can also be fed to the machine by means of a batching device (not shown) instead of the scray as shown. For continuous operation with a preceding shrinking- and heat-setting device 3, it is of advantage to design the delivery chute of this latter aggregate as a material scray. From there, the textile material length 2 is fed into a padder 4. The trough 5 of this padder has a double-jacketed housing for cooling the bonding agent liquor. The squeeze rollers 6 can also be provided with a central bore hole 7 through which a cooling liquid is circulated. Then the material length 2 enters a heating-up duct 8. This duct is provided with infrared heating rods 9, with fans 10 and with radiators 11 for heating the air and for the jet-processing of the textile material length 2. During the shrinking process, the speeds of the padder 4 and of the subsequent washing aggregate 13 can be adapted to each other, taking into consideration the shrinkage of the material, by means of a rocking roller control 12.

The washing aggregate comprises spray pipes 13, squeezers 15, and a sieve drum 16 which is penetrated (traversed) by the processing liquor from the outside to the inside thereof. The washing aggregate is followed by a well known sieve drum dryer 17 which comprises several sieve drums 18 which are subject to a suction draft and around which the textile material length 2 is conveyed, adhering first with one and then with the other side (alternate sides) to the drum surfaces. Those parts of the drums which are not covered by the material being treated are screened against the suction draft by means of baffle plates 19. The dryer is followed by a winding-up device 20.

The invention being thus described, it will be obvious that the same may be varied in many ways. Such variations are not to be regarded as a departure from the spirit and scope of the present invention and all such modifications as would be apparent to one skilled in the art are intended to be included.

What is claimed is:

1. A process for the production of a textile material length containing latex bonding agents for the production of synthetic leather which comprises impregnating the textile material with a thermo-sensibilized latex bonding agent, heating said textile material impregnated with said bonding agent contact-free to a temperature at which the bonding agent coagulates, said latex bonding agent coagulating before drying of said impregnated textile material takes place, washing said textile material impregnated with said bonding agent to remove excess thermo-sensibilizing agent therefrom, subsequently mechanically removing a substantial portion of water from the textile material containing the coagulated latex bonding agent, and thereafter drying and curing the bonding agent within the textile material by drawing a heated gas through said textile material, the passage of said gas through said textile material also increasing the airpermeability of said impregnated textile material.

2. A process for the production of a textile material length containing a latex bonding agent for use in the production of synthetic leather which comprises impregnating the textile material with a thermosensibilized latex bonding agent, guiding the impregnated textile material in a contact-free manner within a heating-up zone, heating said impregnated textile material within said zone to a temperature at which the latex bonding agent coagulates, said latex bonding agent coagulating before drying of said impregnated textile material takes place, washing said textile material by drawing a washing liquor therethrough on a sieve drum means after the latex bonding agent has been coagulated in order to remove excess thermosensibilizing agent contained in said latex bonding agent from the coagulated latex bonding agent and from the textile material and to provide greater air-permeability to said impregnated textile material, subsequently mechanically dehydrating the textile material containing the coagulated latex bonding agent to remove a substantial portion of water therefrom and thereafter drying and curing said latex bonding agent by drawing a heated gas through the textile material as the textile material is conveyed on the surface of at least one sieve drum means subjected to a suction draft, the passage of gas through the textile material further increasing the air-permeability of said impregnated textile material.

3. A process for the production of a textile material length containing a latex bonding agent for the use in the production of synthetic leather which comprises impregnating the textile material with a thermosensibilized latex bonding agent, guiding said impregnated textile material in a contact-free manner within a heating-up zone, heating said impregnated textile material to a temperature at which the latex bonding agent coagulates, said latex bonding agent coagulating before drying of said impregnated textile material takes place, washing said textile material by drawing a washing liquor therethrough on a sieve drum means after the latex bonding agent has been coagulated in order to remove excess thermo-sensibilizing agent contained in said latex bonding agent from the coagulated latex bonding agent and from the textile material and to provide greater air-permeability to said impregnated textile material, and subsequently mechanically dehydrating said textile material to remove a substantial portion of water therefrom and thereafter heating the textile material to dry said material and to dry and to cure or vulcanize said latex bonding agent.

4. The process of claim 1, wherein at least during part of the washing step, a washing liquid is drawn through the textile material length.

5. The process of claim 2, wherein the heated gas is air, steam or an air-steam mixture.

6. The process of claim 2, wherein the bonding agent is a synthetic latex.

7. The process of claim 2, wherein during the impregnating step more than about 300 percent, compared to the fiber weight, of the bonding agent liquor is applied to the textile material length and after the coagulation and washing steps the textile material length is dehydrated to about 100 percent or less of the liquor.

8. The process of claim 2, wherein the textile material length is heated-up for the coagulation of the bonding agent by infrared radiation, jet processing with a heated gas, or by high frequency, the material length being guided substantially vertically through a heating-up zone during the heating step.

9. The process of claim 2, wherein the bonding agent is continually cooled during the impregnation step.

10. The process of claim 9, wherein the impregnated textile length is further cooled prior to effecting coagulation of said latex bonding agent.

11. The process of claim 2, wherein the textile material is pre-washed after coagulation of said latex by spraying said material followed by subsequent squeezing.

* * * * *